US007509078B2

(12) United States Patent
Ueda et al.

(10) Patent No.: US 7,509,078 B2
(45) Date of Patent: Mar. 24, 2009

(54) IMAGE FORMING DEVICE HAVING A PLURALITY OF CARRIER REMOVING MEMBERS

(75) Inventors: Hiroyuki Ueda, Osaka (JP); Koji Murase, Osaka (JP); Hidenori Takenaka, Osaka (JP); Tomoyuki Oda, Osaka (JP); Jumpei Hobo, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 266 days.

(21) Appl. No.: 11/536,626

(22) Filed: Sep. 28, 2006

(65) Prior Publication Data

US 2007/0077095 A1 Apr. 5, 2007

(30) Foreign Application Priority Data

Sep. 30, 2005 (JP) ..... 2005-286929

(51) Int. Cl.
*G03G 15/10* (2006.01)

(52) U.S. Cl. ..... 399/249; 399/237

(58) Field of Classification Search ..... 399/237, 399/239, 240, 249
See application file for complete search history.

(56) References Cited

U.S. PATENT DOCUMENTS 6,282,392 B1 * 8/2001 Yamaguchi ..... 399/237
6,445,897 B2 * 9/2002 Uezono et al. ..... 399/237
2004/0047656 A1 * 3/2004 Sakai et al. ..... 399/249

FOREIGN PATENT DOCUMENTS

JP 2002-296918 A 10/2002

* cited by examiner

*Primary Examiner*—Hoang Ngo
(74) *Attorney, Agent, or Firm*—Global IP Counselors, LLP

(57) ABSTRACT

A wet image forming device includes a plurality of developer support members that support a developer including a toner and a carrier functioning as a toner transfer agent, a plurality of image support members, the outer peripheral surfaces of each contacting the plurality of developer support members, and which support an electrostatic latent image developed with toner included in the developer supported by the plurality of developer support members, an intermediate transfer member to which an image developed on each of the plurality of image support members is transferred, a transfer roller that is pressed into contact with each of the plurality of image support members through the intermediate transfer member, and one or more carrier removing members that remove the carrier and arranged between a first image support member that is one of the plurality of image support members and a second image support member that is located adjacent to the first image support member.

13 Claims, 8 Drawing Sheets

IMAGE FORMING DEVICE HAVING A PLURALITY OF CARRIER REMOVING MEMBERS

This application claims priority to Japanese Patent Application No. 2005-286929. The entire disclosure of Japanese Patent Application No. 2005-286929 is hereby incorporated herein by reference.

BACKGROUND OF THE INVENTION

Field of the Invention

The present invention relates to a wet image forming device, and more particularly to a wet image forming device which has a carrier removal function.

In conventional wet image forming devices, a large amount of developer, and in particular carrier, will become attached to an intermediate transfer member after the first transfer step or before the second transfer step. In addition, one problem that is caused thereby is that surplus carrier attached to the intermediate transfer member causes "bleeding" and "dripping" in the transferred image when additional developer is transferred in the next step while in this state.

Japan Patent Application Publication JP-A-2002-296918 discloses a wet image forming device comprising a liquid removing roller for removing surplus developer from overlapping toner images transferred to an intermediate transfer belt functioning as an intermediate transfer member before the second transfer step for transferring the toner image to a sheet of recording paper. In addition, it is possible to remove only surplus carrier solution while preventing the attachment of toner included in the developer to the liquid removing roller by applying a bias potential to the liquid removing roller.

Because of this, it is possible to remove surplus carrier solution before the second transfer step is performed, and it is possible to perform the second transfer step with little dripping and distortion in an image.

However, in the wet image forming device described in Japan Patent Application Publication JP-A-2002-296918, carrier is removed from the intermediate transfer member before the second transfer step, in which a toner image is transferred from the intermediate transfer member to a sheet of recording paper and the like. Therefore, even if it reduces "bleeding" and "dripping" in an image produced in the second transfer step, it is impossible to reduce "bleeding" and "dripping" in an image in the first transfer step.

Therefore, it is an object of the present invention to take the above described situation into consideration, and provide a wet image forming device that can reduce "bleeding" and "dripping" in an image in the first transfer step in which an image is transferred to an intermediate transfer member.

SUMMARY OF THE INVENTION

In order to achieve the above described object, the present invention is applied to a wet image forming device that comprises a plurality of developer support members that support developer comprising toner and a carrier functioning as a toner transfer agent, a plurality of image support members, the outer peripheral surfaces of which respectively contact the plurality of developer support members, and which support an electrostatic latent image developed with the toner included in the developer supported by the plurality of developer support members, an intermediate transfer member to which an image developed on each of the plurality of image support members is transferred, and a transfer roller that is pressed into contact with each of the plurality of image support members through the intermediate transfer member. In addition, the present invention further comprises one or more carrier removing members that remove the carrier and are disposed between a first image support member that is one of the plurality of image support members and a second image support member that is located adjacent to the first image support member.

With this configuration, it is possible to remove surplus carrier attached to the intermediate transfer member when the first transfer step of transferring an image to the intermediate transfer member is performed. Specifically, the one or more carrier removing members remove carrier attached to the intermediate transfer member after the toner image developed on the first image transfer member (one of the plurality of image support members) is transferred to the intermediate transfer member and before the toner image developed on the second image support member is transferred to the intermediate transfer member. Because of this, it is possible to reduce the occurrence of "bleeding" and "dripping" in the toner image when the toner image developed on the second image support member is transferred to the intermediate transfer member.

In addition, it is desirable that the wet image forming device further comprises a voltage application unit that applies a voltage with the same polarity as that of the toner to the one or more carrier removing members. Because of this, it is possible to prevent toner from attaching to the one or more carrier removing members and to removal only surplus carrier.

Furthermore, the wet image forming device may further comprise a cleaning member that removes at least the carrier attached to the one or more carrier removing members. Because of this, it is possible to remove at least the carrier attached to the one or more carrier removing members. In addition, it is also possible to remove attached material other than carrier. As a result, the carrier removal function will no longer be affected by surplus carrier remaining on the one or more carrier removal members, and the one or more carrier removing members can always remove surplus carrier from the intermediate transfer member without carrier being attached to the one or more carrier removing members.

In addition, the wet image forming device may further comprise a support roller in which the intermediate transfer member is interposed between the support roller and the one or more carrier removing members. Because the intermediate transfer member is interposed between the support roller and the one or more carrier removing members, the one or more carrier removing members will easily remove carrier from the intermediate transfer member.

On the other hand, when monochrome image formation is performed with the wet image forming device, it is desirable that the wet image forming device comprises a separation mechanism that separates one or more of the plurality of image support members corresponding to one or more colors not used for image formation, the transfer roller that is pressed into contact with the plurality of image support members, the one or more carrier removing members disposed on the downstream side in the direction of travel of the intermediate transfer member from the plurality of image support members, and the support roller having the intermediate transfer member interposed between itself and the one or more carrier removing members, from the intermediate transfer member.

For example, in the event that monochrome image formation is performed in a tandem wet image forming device that performs a first transfer step of sequentially forming toner images of different colors (e.g., black (K), magenta (M), cyan (C), and yellow (Y)) on the intermediate transfer member, and performs a second transfer step of transferring the toner image formed on the intermediate transfer member to a sheet of recording paper, and then fixes the image, when carrier is removed by the one or more carrier removing members disposed on the downstream side in the direction of travel of the intermediate transfer member from the image support members that correspond to colors other than black, then surplus carrier will be removed, even though the image support members that correspond to colors other than black are not used. Because of this, when monochrome image formation is performed, one or more of the plurality of image support members corresponding to colors not used for image formation (i.e., colors other than black (K)), the transfer roller that is pressed into contact with the image support members, the one or more carrier removing members disposed on the downstream side in the direction of travel of the intermediate transfer member from the image support members, and the support roller having the intermediate transfer member interposed between itself and the one or more carrier removing members, will be separated from the intermediate transfer member. Therefore, surplus carrier will not be removed and degradation of image quality can be reduced.

In addition, the separation mechanism may separates the plurality of image support members and the one or more carrier removing members from the intermediate transfer member. If the one or more carrier removing members are separated from the image transfer member, the one or more carrier removing members will have the image transfer member interposed between themselves and the support roller. Therefore, the carrier removal function can be reduced. As a result, excessive carrier will not be removed, and degradation of image quality can be reduced.

Furthermore, the separation mechanism may separate the transfer roller and the support roller from the intermediate transfer member. If the support roller is separated from the image transfer member, the support roller cannot have the image transfer member interposed between itself and the one or more carrier removing members. Therefore, the carrier removal function can be reduced. As a result, excessive carrier will not be removed, and degradation of image quality can be reduced.

Furthermore, if the plurality of image support members corresponding to colors other than a color used for monochrome image formation, the one or more carrier removing members, the transfer roller, and the support roller, are separated from the intermediate transfer member, members other than the image support member corresponding to a color used for monochrome image formation, the one or more carrier removing members, the transfer roller, and the support roller, will not contact the intermediate transfer member at all. Therefore, excessive carrier will not be removed, and degradation of image quality can be reduced.

According to the present invention, excessive carrier attached to an intermediate transfer member can be removed during a first transfer step for transferring an image to the intermediate transfer member. Therefore, the occurrence of "bleeding" and "dripping" in an image can be reduced during the first transfer step of transferring an image to the intermediate transfer member.

These and other objects, features, aspects, and advantages of the present invention will become apparent to those skilled in the art from the following detailed description, which taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the attached drawings to understand the present invention. Note that it will be apparent to those skilled in the art from this disclosure that the following descriptions of the embodiments of the present invention are provided for illustration only and not for the purpose of limiting the invention as defined by the appended claims and their equivalents.

First Embodiment

Figure 1:
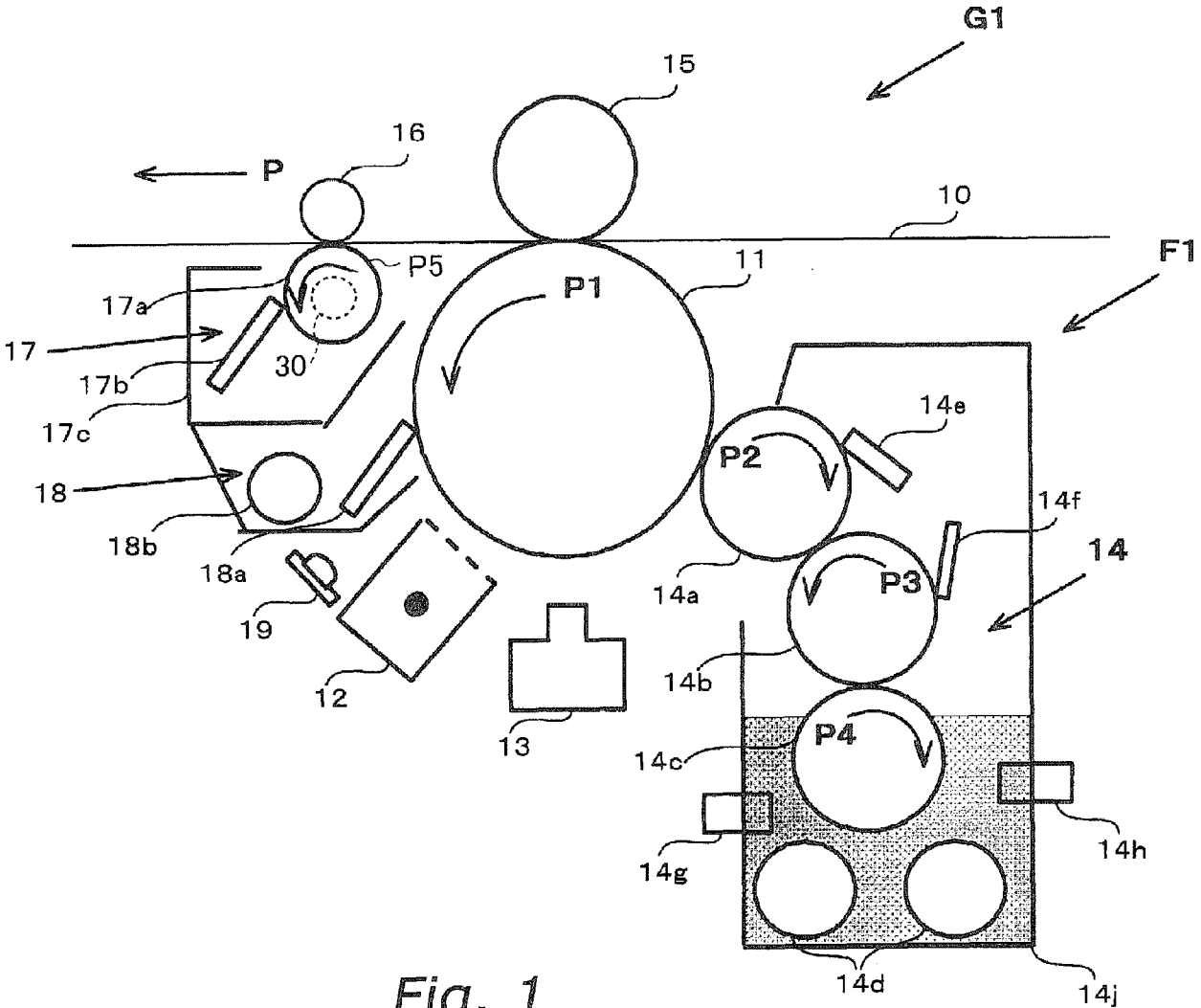
FIG. 1 shows a photosensitive drum and its vicinity in a wet image forming device X1 in accordance with a first embodiment of the present invention.
Figure 2:
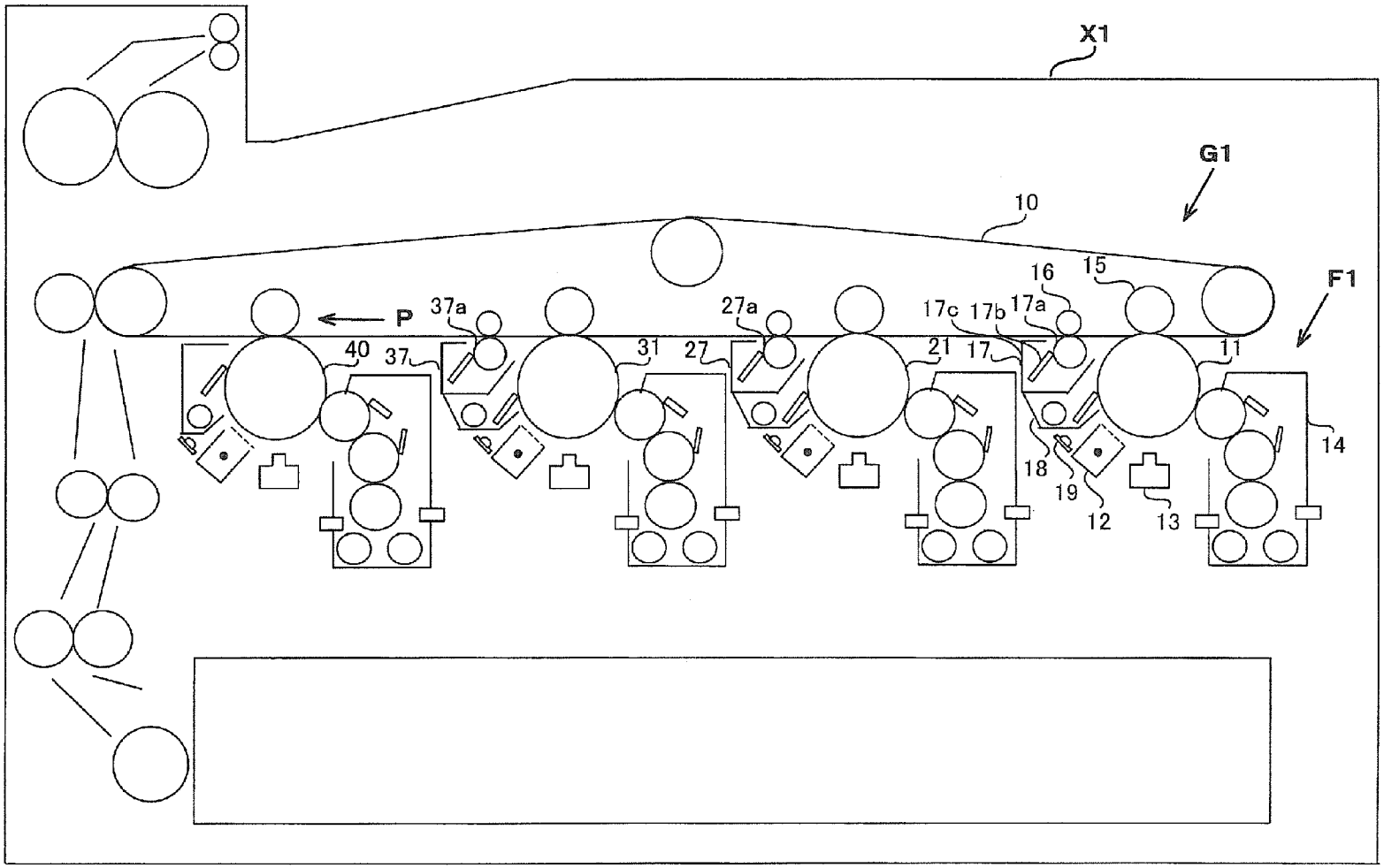
FIG. 2 shows the wet image forming device X1 in accordance with the first embodiment of the present invention.
Figure 3:
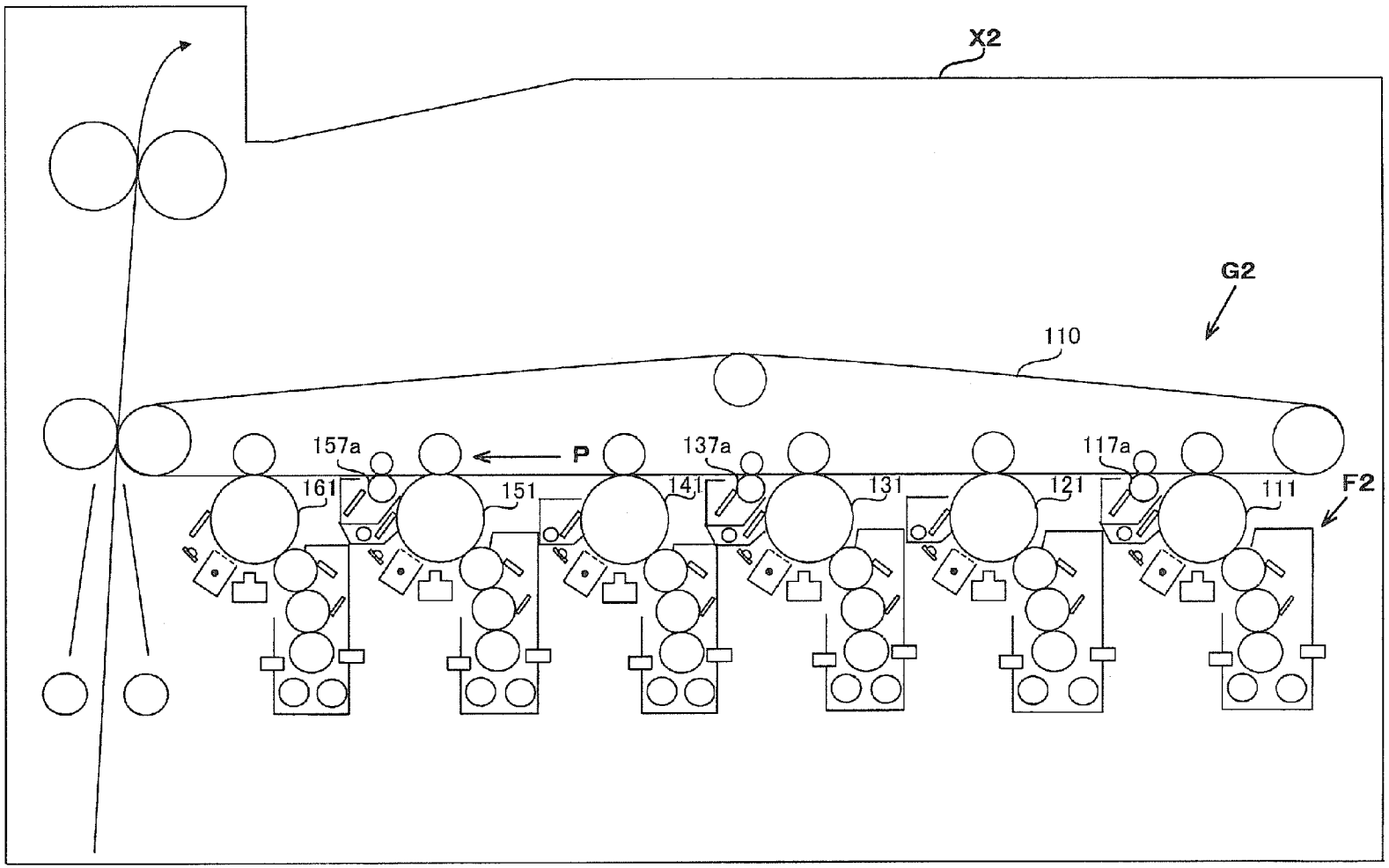
FIG. 3 shows a wet image forming device X2 in accordance with a second embodiment of the present invention.
Figure 4:
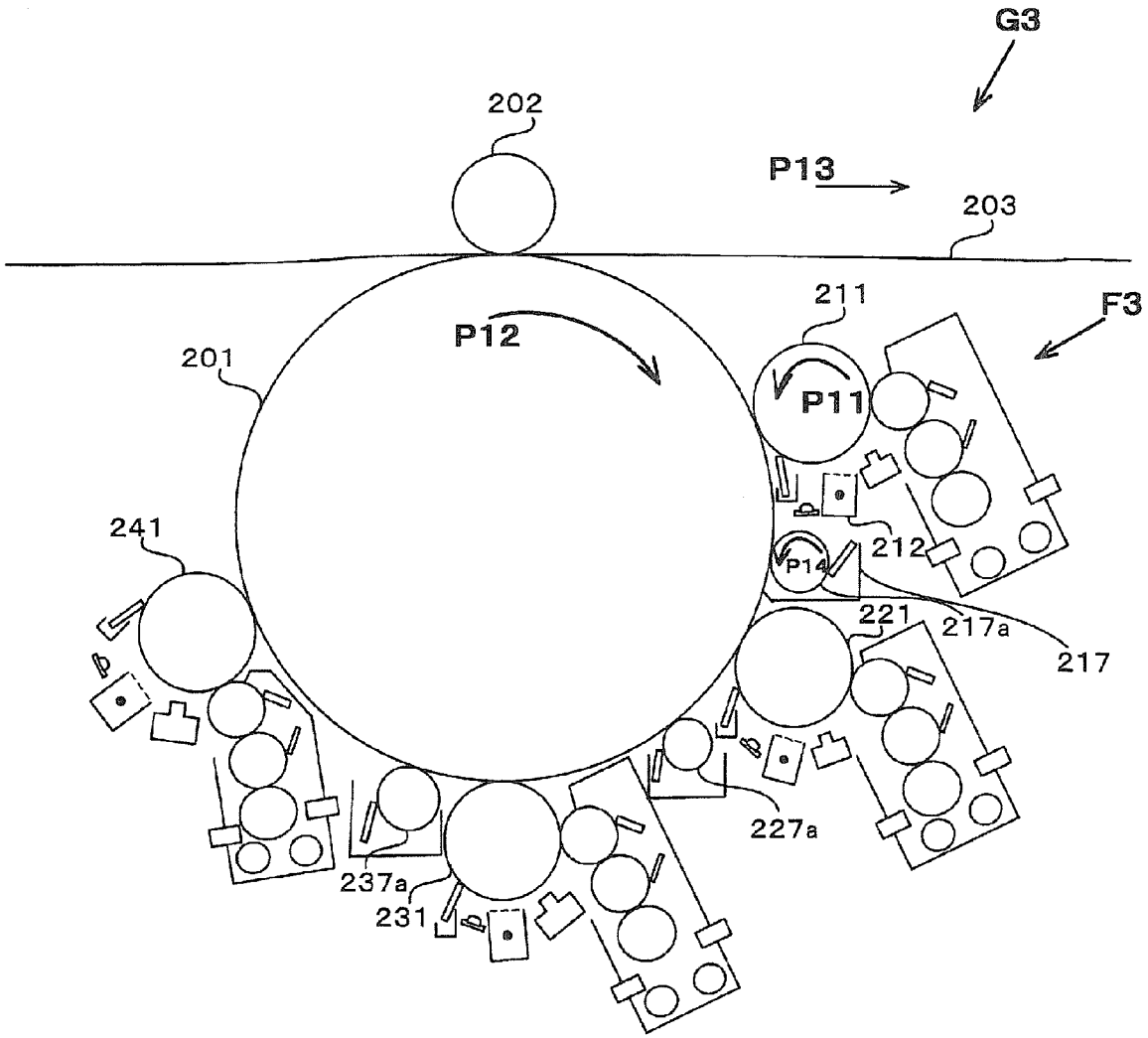
FIG. 4 shows an intermediate transfer drum and its vicinity in a wet image forming device X3 in accordance with a third embodiment of the present invention.
Figure 5:
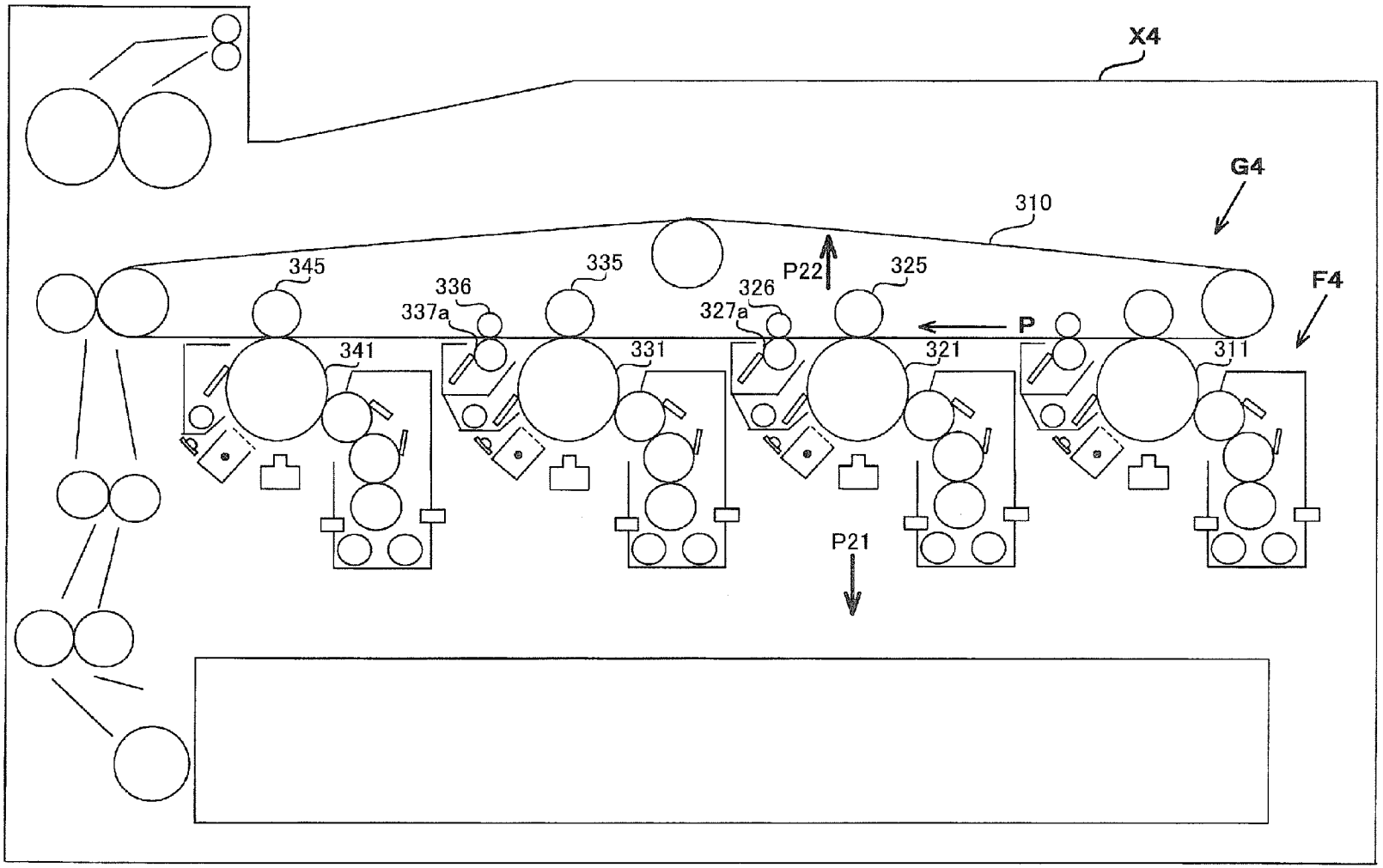
FIG. 5 shows a wet image forming device X4 in accordance with a fourth embodiment of the present invention.
Figure 6:
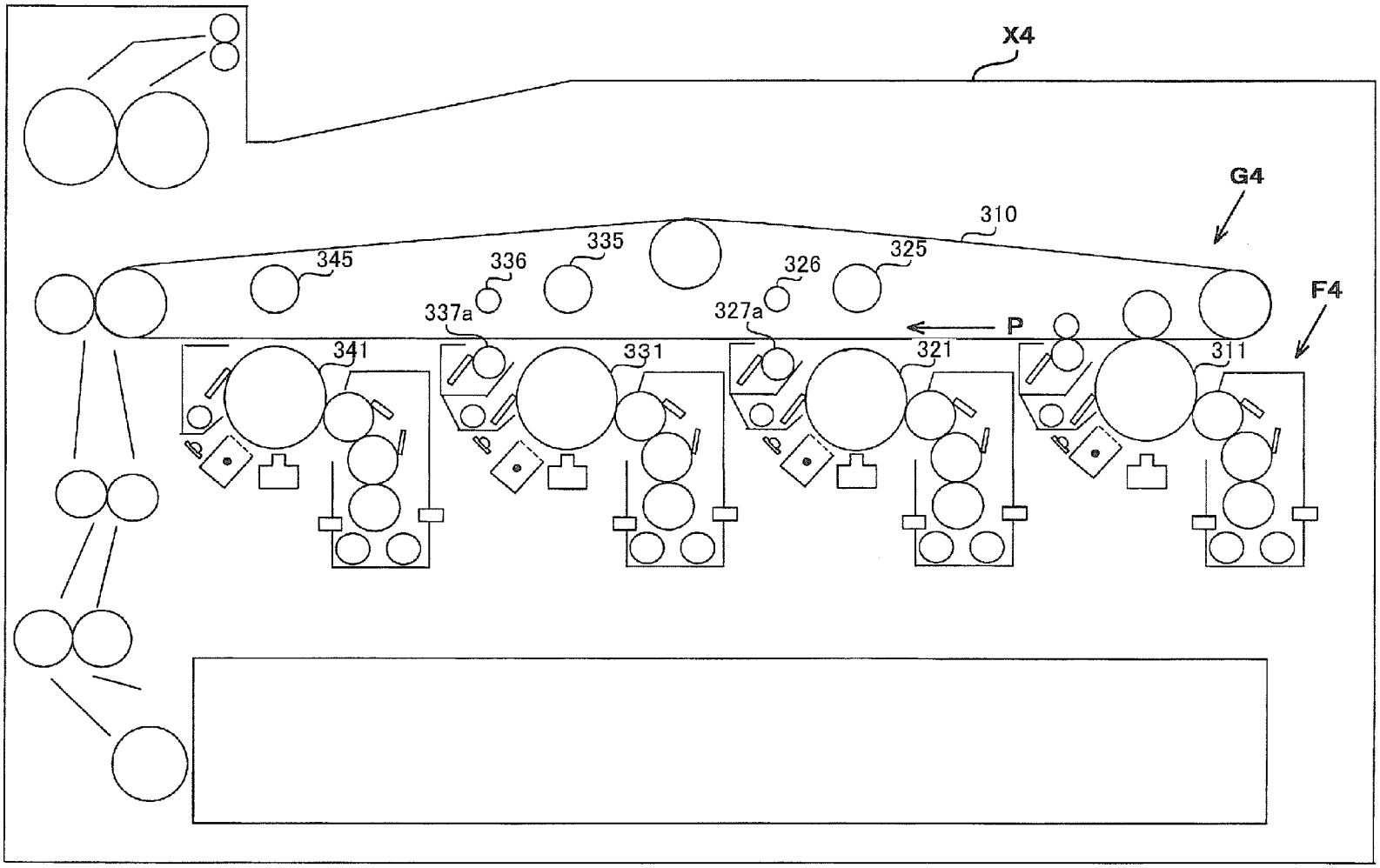
FIG. 6 shows a wet image forming device X4 in accordance with the fourth embodiment of the present invention after a separation mechanism is operated.

FIG. 1 shows a photosensitive drum and its vicinity in a wet image forming device X1 in accordance with the first embodiment of the present invention. FIG. 2 shows the wet image forming device X1. FIG. 3 shows a wet image forming device X2 in accordance with a second embodiment of the present invention. FIG. 4 shows an intermediate transfer drum and its vicinity in a wet image forming device X3 in accordance with a third embodiment of the present invention. FIG. 5 shows a wet image forming device X4 in accordance with a fourth embodiment of the present invention. FIG. 6 shows a wet image forming device X4 in accordance with the fourth embodiment of the present invention after a separation mechanism is operated.

In the present embodiment, the wet image forming device X1 comprises at least four exposing units, four photosensitive drums, and four developing units that correspond to four colors of black (K), magenta (M), cyan (C), and yellow (Y), respectively. In addition, it employs a four color tandem method by which four color toner image formation can be simultaneously performed. Furthermore, it employs an intermediate transfer belt method in which a first transfer step of transferring an image developed on the photosensitive drum to an intermediate transfer belt is performed, and then a second transfer step of transferring the image to a sheet of recording paper and the like is performed. In addition, the developing unit employs a two-component developing method in which development is performed with developer comprising non-magnetic toner and carrier.

First, a schematic configuration of an image forming unit G1 that is disposed in the wet image forming device X1 in accordance with the first embodiment of the present invention will be described with reference to FIG. 1.

Here, the image forming unit G1 comprises an intermediate transfer belt 10 (an example of an intermediate transfer member) to which an image developed on a photosensitive drum 11 is transferred, toner image forming units F1, each of which corresponds to the colors black (K), magenta (M), cyan (C), and yellow (Y), respectively, and a carrier removing unit. Note that the order of the four colors is not limited to that of the present embodiment. As described below, each of the toner image forming units F1 comprises a developing unit, a photosensitive drum, a first transfer roller, an electrostatic charging unit, an exposing unit, a cleaning unit, and a neutralization lamp.

The toner image forming unit F1 corresponding to the color black (K) will be hereinafter described as an example of the toner image forming units F1.

The toner image forming unit F1 of the color black (K) is comprised of a developing unit 14 with which members such as a developing roller 14*a* (an example of a developer support member) for supporting developer comprising at least toner and carrier functioning as a toner transport member and the like are provided, a photosensitive drum 11 (an example of an image support member) whose outer peripheral surface contacts the outer peripheral surface of the developing roller 14*a* and supports an electrostatic latent image to be developed with the toner in the developer supported by the developing roller 14*a*, a first transfer roller 15 that is pressed into contact with the photosensitive drum 11 through the intermediate transfer belt 10, a first transfer bias application unit (not shown in the figure), an electrostatic charging unit 12 for uniformly charging the surface of the photosensitive drum 11, an exposing unit 13 that forms an electrostatic latent image by irradiating a laser beam onto the photosensitive drum 11, a cleaning unit 18 for cleaning the photosensitive drum 11 after the transfer step, and a neutralization lamp 19 for removing residual potential remaining on the photosensitive drum 11 after the transfer step.

The intermediate transfer belt 10 travels in the direction of the arrow P shown in FIGS. 1 and 2.

The intermediate transfer belt 10 corresponds to an intermediate transfer member to which an image developed on the image support member is transferred.

The first transfer bias application unit is disposed in the first transfer roller 15, and applies a bias having a polarity that is the inverse of that of the toner to the first transfer roller 15.

The first transfer bias application unit applies a transfer bias with a polarity that is the inverse of that of the charging polarity of toner to the first transfer roller 15 facing the photosensitive drum 11, in order to transfer the toner image supported on the surface of the photosensitive drum 11 to the intermediate transfer belt 10.

The first transfer roller 15 is an example of a transfer roller that is pressed into contact with the image support member through the intermediate transfer member.

The developing unit 14 is comprised of a developer container 14*j* in which developer comprising at least toner and a carrier functioning as a toner transport member are stored, a plurality of agitation spirals 14*d* for agitating developer stored in the developer container 14*j*, a drawing roller 14*c* for drawing developer stored in the developer container 14*j* by rotation thereof, a supply roller 14*b* whose outer peripheral surface contacts that of the drawing roller 14*c* and that supplies the developing roller 14*a* with developer drawn by the drawing roller 14*c*, the developing roller 14*a* whose outer peripheral surface contacts that of the supply roller 14*b* and that supports developer supplied by the supply roller 14*b* and develops an electrostatic latent image formed on the photosensitive drum 11, a supply roller doctor blade 14*f* for controlling the thickness of developer supported by the supply roller 14*b* so as to be approximately uniform, a developing roller cleaning blade 14*e* that contacts the developing roller 14*a* and removes developer attached to the developing roller 14*a*, a toner concentration sensor 14*g* for measuring the concentration of toner included in developer stored in the developer container 14*j*, and a toner liquid level sensor 14*h* for detecting the liquid level of developer stored in the developer container 14*j*.

Here, the developing roller 14*a* corresponds to a developer support member that supports developer comprising toner and carrier functioning as a toner transport agent.

The outer peripheral surface of the photosensitive drum 11 contacts that of the developer support member, and corresponds to an image support member that supports an electrostatic latent image developed with toner included in the developer that is supported by the developer support member.

The cleaning unit 18 comprises a cleaning blade 18*a* for removing developer remaining on the surface of the photosensitive drum 11 after the intermediate transfer step, and a screw 18*b* that transports and discharges the removed developer.

The carrier removing unit is disposed between an image support member and the other image support member located adjacent thereto. Specifically, as shown in FIG. 2, a carrier removing unit 17 is disposed between the photosensitive drum 11 that is disposed in the toner image forming unit F1 corresponding to black (K) toner and a photosensitive drum 21 that is disposed in the toner image forming unit F1 corresponding to magenta (M) toner. In addition, a carrier removing unit 27 is disposed between the photosensitive drum 21 that is disposed in the toner image forming unit F1 corresponding to magenta (M) toner and a photosensitive drum 31 that is disposed in the toner image forming unit F1 corresponding to cyan (C) toner. Furthermore, a carrier removing unit 37 is disposed between the photosensitive drum 31 that is disposed in the toner image forming unit F1 corresponding to cyan (C) toner and a photosensitive drum 41 that is disposed in the toner image forming unit F1 corresponding to yellow (Y) toner.

As shown in FIGS. 1 and 2, the carrier removing unit 17 disposed between the photosensitive drum 11 that is disposed in the toner image forming unit F1 corresponding to black (K) toner and the photosensitive drum 21 that is disposed in the toner image forming unit F1 corresponding to magenta (M) toner is comprised of a carrier removing roller 17*a* (an example of a carrier removing member) for removing carrier attached to the intermediate transfer belt 10, a carrier removing roller blade 17*b* (an example of a cleaning member) for removing carrier attached to the carrier removing roller 17*a*, a retrieving container 17*c* for retrieving carrier removed by the carrier removing roller blade 17*b*, a support roller 16 (an example of a support roller) which has the intermediate transfer belt 10 interposed between itself and the carrier removing roller 17*a*, and a bias application unit 30.

The bias application unit 30 is disposed in the interior of the carrier removing roller 17*a*, and applies a bias with the same polarity as that of the toner to the carrier removing roller 17*a*. Here, the bias application unit 30 corresponds to a voltage application unit for applying a bias with the same polarity as that of the toner to a carrier removing member.

As described above, the carrier removing roller 17*a* is arranged to be in contact with the intermediate transfer belt 10. The carrier removing roller 17*a* may be a metal roller comprised of metal such as iron, aluminum, and the like, a metal shaft on which a conductive elastic layer and a coat later are sequentially formed, and a belt roller.

As described above, the support roller 16 is disposed in a position that faces the carrier removing roller 17*a* through the intermediate transfer belt 10. The bias application unit 30 applies a bias with the same polarity as that of the toner to the carrier removing roller 17*a*. Here, the support roller 16 is an example of a support roller in which the intermediate transfer member is interposed between the support roller and the carrier removing member.

The carrier removing roller blade 17*b* corresponds to a cleaning member for cleaning at least carrier attached to the carrier removing member.

The configuration of the toner image formation units F1 corresponding to the magenta (M) toner, the cyan (C) toner, and the yellow (Y) toner are the same as the configuration of the toner image forming unit F1 corresponding to the black (B) toner. Therefore, a description thereof will be hereinafter omitted.

The basic operation of the image forming unit G1 with the above described configuration is as follows.

First, the basic operation of the toner image forming unit F1 corresponding to black (K) toner will be hereinafter described. As shown in FIG. 1, the photosensitive drum 11 is rotationally driven in a counterclockwise direction (i.e., the direction of arrow P1), and the electrostatic charging unit 12 uniformly charges the surface of the rotating photosensitive drum 11. Because of this, the residual electrostatic latent image is cleared. After the surface of the photosensitive drum 11 passes the electrostatic charging unit 12, the exposing unit 13 irradiates a laser beam on the surface of the photosensitive drum 11. Thus, an electrostatic latent image is formed.

As shown in FIG. 1, the developing roller 14*a* arranged so that the outer peripheral surface thereof contacts that of the photosensitive drum 11 is rotated in the clockwise direction (i.e., the direction of arrow P2) in synchronization with the rotary drive of the photosensitive drum 11 in the counterclockwise direction (i.e., the direction of arrow P1) on the downstream side of the rotational direction of the photosensitive drum 11 from the exposing unit 13. Furthermore, the supply roller 14*b* whose outer peripheral surface contacts that of the developing roller 14*a* rotates in the counterclockwise direction (the direction of arrow P3). As a result, the drawing roller 14*c* rotates in the clockwise direction (the direction of arrow P4). Because of this, developer is supported by the drawing roller 14*c*, and the thickness thereof is controlled to be approximately uniform by the roller doctor blade 14*f*. Then, the developer is supplied to the supply roller 14*b*. The supplied developer is supported by the supply roller 14*b*, and is supplied to the developing roller 14*a*. Toner included in the developer that is supported by the developing roller 14*a* is attracted to the electrostatic latent image formed on the photosensitive drum 11, and thus the electrostatic latent image is developed. After the development step, the developer attached to the developing roller 14*a* is removed by the developing roller cleaning blade 14*e*, and is prepared for the next developer supply step.

The black toner image developed on the photosensitive drum 11 is transferred to the outer peripheral surface of the intermediate transfer belt 10 due to the first transfer roller 15 having a transfer bias with a polarity that is the inverse of the charging polarity of toner applied thereto by the first transfer bias application unit.

After the above described first transfer step, a large amount of developer, particularly developer, will be attached to the intermediate transfer belt 10. Because of this, if additional developer is transferred in the next step while in this state, the surplus carrier will cause problems such as "bleeding" and "dripping" in the transferred image. Therefore, the following operation is performed by the carrier removing unit 17. When the intermediate transfer belt 10 moves, the carrier removing roller 17*a* that is disposed between the photosensitive drum 11 and the photosensitive drum 21 located adjacent to the photosensitive drum 11 will rotate in the counterclockwise direction (i.e., the direction of arrow P5). The carrier removing roller 17*a* will remove developer attached to the intermediate transfer belt 10 by interposing the intermediate transfer belt 10 between itself and the support roller 16. Then, the bias application unit 30 disposed in the interior of the carrier removing roller 17*a* applies a bias with the same polarity as that of the toner to the carrier removing roller 17*a*. Thus, the toner will be pressed into contact with the intermediate transfer belt 10, and the carrier removing roller 17*a* will remove at least the components of the developer other than the toner, in other words, the carrier. At this point, it is desirable to apply a bias of +200 to +500 V to the carrier removing roller 17*a*. In general, the surface energy of the carrier removing roller 17*a* is 20 to 2000 dynes/cm. The higher the surface energy of the carrier removing roller 17*a* is compared to the intermediate transfer belt, the greater the efficiency of developer removal will be.

The carrier removing roller blade 17*b* contacts the carrier removing roller 17*a*. When the carrier removing roller 17*a* rotates in the above described direction, the carrier removing roller blade 17*b* removes carrier attached to the surface of the carrier removing roller 17*a*. The carrier removed by the carrier removing roller blade 17*b* is retrieved in the retrieving container 17*c*.

With this configuration, carrier attached to the intermediate transfer belt 10 is removed by the carrier removing roller 17*a* after the toner image developed on the photosensitive drum 11 disposed in the toner image forming unit F1 corresponding to black (K) toner is transferred to the intermediate transfer belt 10, and before the toner image developed on the photosensitive drum 21 that is disposed in the toner image forming unit F1 corresponding to magenta (M) toner and located adjacent to the photosensitive drum 11 is transferred to the intermediate transfer belt 10. Because of this, it is possible to reduce the occurrence of "bleeding" and "dripping" in the toner image when the toner image developed on the photosensitive drum 21 is transferred to the intermediate transfer belt 10.

Furthermore, the cleaning blade 18*a* for removing developer remaining on the surface of the photosensitive drum 11 is disposed on the further downstream side of the photosensitive drum 11. The cleaning blade 18*a* contacts the photosensitive drum 11, and when the photosensitive drum 11 is rotationally driven in the counterclockwise direction (i.e., the direction of arrow P1), the cleaning blade 18*a* will remove the developer remaining on the surface of the photosensitive drum 11. The screw 18*b* discharges the developer removed by the cleaning blade 18*a*.

The neutralization lamp 19 is disposed on the further downstream side of the photosensitive drum 11. The neutralization lamp 19 removes the potential remaining on the photosensitive drum 11 after the transfer step. Then, the electrostatic charging unit 12 uniformly charges the surface of the photosensitive drum 11, and the next image forming processing will be performed.

The same basic operation as that performed by the toner image forming unit F1 corresponding to black (K) toner is performed in the toner image forming unit F1 corresponding to magenta (M) toner, and the magenta toner image will be overlapped with the intermediate transfer belt 10. Next, the same basic operation as that performed by the carrier removing unit 17 is performed by the carrier removing unit 27 disposed between the photosensitive drum 21 that is disposed in the toner image forming unit F1 corresponding to magenta (M) toner and the photosensitive drum 31 that is disposed in the toner image forming unit F1 corresponding to cyan (C) toner, and the carrier attached to the intermediate transfer belt 10 is removed.

The same basic operation as that performed by the toner image forming unit F1 corresponding to black (K) toner is performed in the toner image forming unit F1 corresponding to cyan (C) toner, and the cyan toner will be overlapped with the intermediate transfer belt 10. Next, the same basic operation as that performed by the carrier removing unit 17 is performed by the carrier removing unit 37 disposed between the photosensitive drum 31 that is disposed in the toner image forming unit F1 of the cyan (C) toner and the photosensitive drum 41 that is disposed in the toner image forming unit F1 corresponding to the yellow (Y) toner, and the carrier attached to the intermediate transfer belt 10 is removed.

The same basic operation as that performed by the toner image forming unit F1 corresponding to the black (K) toner is performed by the toner image forming unit F1 corresponding to the yellow (Y) toner, and the yellow toner image will be overlapped with the intermediate transfer belt 10.

When toner images of all colors are overlapped on the intermediate transfer belt 10, a second transfer step is performed in which the toner image formed on the intermediate transfer belt 10 is transferred to a sheet of recording paper and the like. Heat is applied to the toner image transferred to the recording paper and the like, and thus the toner image is fixed.

Note that as shown in FIG. 2, in this configuration, the number of carrier removing rollers 17*a* disposed between the photosensitive drum 11 that is disposed in the toner image forming unit F1 corresponding to black (K) toner and the photosensitive drum 21 that is disposed in the toner image forming unit F1 corresponding to magenta (M) toner, the number of carrier removing rollers 27*a* disposed between the photosensitive drum 21 that is disposed in the toner image forming unit F1 corresponding to magenta (M) toner and the photosensitive drum 31 that is disposed in the toner image forming unit F1 corresponding to cyan (C) toner, and the number of carrier removing rollers 37*a* disposed between the photosensitive drum 31 that is disposed in the toner image forming unit F1 corresponding to cyan (C) toner and the photosensitive drum 41 that is disposed in the toner image forming unit F1 corresponding to yellow (Y) toner is one, respectively. However, a plurality of carrier removing rollers may be disposed between each of the photosensitive drums. In other words, this corresponds to a configuration in which one or more carrier removing members for removing carrier are disposed between the first image support member (that is one of a plurality of image support members) and the second image support member that is located adjacent to the first image support member.

Second Embodiment

Second to fourth embodiments of the present invention will now be described by focusing on the differences with the above described first embodiment of the present invention. In view of the similarity between the first embodiment and the second to fourth embodiments, the parts of the second to fourth embodiments that are identical to the parts of the first embodiment will be given the same numerals as the parts of the first embodiment. Moreover, the descriptions of the parts of the second to fourth embodiments that are identical to the parts of the first embodiment may be omitted for the sake of brevity.

The second embodiment relates to a six color tandem wet image forming device X2 in which at least an exposing unit, a photosensitive drum, and a developing unit are arranged for each of six color toners, i.e., black (K), magenta (M), cyan (C), yellow (Y), light cyan (LC), and light magenta (LM), and toner image formation for each of the six colors can be simultaneously performed.

First, in reference to FIG. 3, only the portions of the wet image forming device X2 in accordance with the second embodiment of the present invention that are different from those of the wet image forming device X1 of the first embodiment will be described below.

A image forming unit G2 in the wet image forming device X2 is provided with a plurality of toner image forming units F2, each of which corresponds to each of the above described six colors.

The differences between the wet image forming device X2 and the wet image forming device X1 are as follows. In the wet image forming device X1 in accordance with the above described first embodiment, a carrier removing roller is disposed in every space formed between adjacent photosensitive drums. However, in the wet image forming device X2 according to the second embodiment, a carrier removing roller 117*a* is disposed between a photosensitive drum 111 corresponding to a first color and a photosensitive drum 121 corresponding to a second color, and a carrier removing roller 137*a* is disposed between a photosensitive drum 131 corresponding to a third color and a photosensitive drum 141 corresponding to a forth color, and a carrier removing roller 157*a* is disposed between a photosensitive drum 151 corresponding to a fifth color and a photosensitive drum 161 corresponding to a sixth color.

The carrier removing rollers 117*a*, 137*a*, and 157*a* are arranged so as to contact the intermediate transfer belt 110 as with the carrier removing rollers in accordance with the above described first embodiment.

The carrier removing roller 117*a* removes the carrier attached to the intermediate transfer belt 110 after the toner developed on the photosensitive drum 111 disposed in the toner image forming unit F2 corresponding to the first color is transferred to the intermediate transfer belt 110, and before the toner image developed on the photosensitive drum 121 disposed in the toner image forming unit F2 corresponding to the second color that is located adjacent to the photosensitive drum 111 is transferred to the intermediate transfer belt 110. Because of this, it is possible to reduce the occurrence of "bleeding" and "dripping" in the toner image when the toner image developed on the photosensitive drum 121 is transferred to the intermediate transfer belt 110.

The carrier removing rollers 137*a* and 157*a* remove the carrier attached to the intermediate transfer belt 110 as with the carrier removing roller 117*a*.

If excessive carrier attaches to the intermediate transfer belt 110, "bleeding" and "dripping" are produced in the toner image. On the other hand, if too little carrier attaches to the intermediate transfer belt 110, it will be difficult to transfer the toner image. Furthermore, if carrier does not attach to the intermediate transfer belt at all, the toner image will not be transferred. Because of this, the wet image forming device X2 has the above described configuration in which excessive carrier will not be removed.

Third Embodiment

A wet image forming device X3 in accordance with the third embodiment employs a four color tandem method in which at least an exposing unit, a photosensitive drum, and a developing unit are arranged for each of four color toners, i.e., black (K), magenta (M), cyan (C), and yellow (Y), and toner image formation of the four colors can be simultaneously performed. In addition, the wet image forming device X3 employs a drum method in which the image developed on the photosensitive drum is first transferred to the intermediate transfer drum and then transferred to a sheet of recording paper and the like.

In the above described first embodiment, a first transfer step is performed with respect to the intermediate transfer belt 10. However, in the wet image forming device X3 in accordance with the third embodiment, a first transfer step is performed with respect to an intermediate transfer drum 201.

With reference to FIG. 4, the configuration of an image forming unit G3 disposed in the wet image forming device X3 used for the third embodiment of the present invention will be hereinafter described.

The image forming unit G3 comprises the intermediate transfer drum 201 (an example of an intermediate transfer member) on which the image developed on a photosensitive drum 211 is transferred, four toner image forming units F3, each of which corresponds to the colors black (K), magenta M, cyan (C), and yellow (Y), carrier removing units, a second transfer roller 202 that is pressed into contact with the intermediate transfer drum 201 through a recording medium 203 such as a sheet of recording paper and the like, and a second transfer bias application unit (not shown in the figure).

The second transfer bias application unit is disposed in the second transfer roller 202, and applies a bias with the same polarity as that of the polarity of the toner to the second transfer roller 202.

The second bias application unit applies a transfer bias with a polarity that is the inverse of that the charging polarity of toner to the second transfer roller 202 in order to transfer the toner image transferred to the surface of the intermediate transfer drum 201 to the recording medium 203. Each of the toner image forming units F3 in accordance with the third embodiment comprises a developing unit, a photosensitive drum, an electrostatic charging unit, an exposing unit, a cleaning unit, and a neutralization lamp, as with the toner image forming units F1 in accordance with the above described first embodiment.

As an example of the toner image forming units F3, an image forming unit F3 corresponding to the color black (K) will be hereinafter described.

The outer peripheral surface of the intermediate transfer drum 201 contacts that of the photosensitive drum 211 corresponding to a first toner color, a photosensitive drum 221 corresponding to a second toner color, a photosensitive drum 231 corresponding to a third toner color, and a photosensitive drum 241 corresponding to the fourth toner color. In addition, a first transfer bias application unit disposed in the interior of the intermediate transfer drum 201 applies a transfer bias with a polarity that is the inverse of the charging polarity of toner to the intermediate transfer drum 201, in order to transfer the toner image that is supported on the surface of the photosensitive drum 211 to the outer peripheral surface of the intermediate transfer drum 201.

A carrier removing unit is disposed between an image support member and another image support member that is located adjacent to this image support member. Specifically, a carrier removing roller 217*a* is disposed between the photosensitive drum 211 that is arranged in the toner image forming unit F3 corresponding to black (K) and the photosensitive drum 221 that is arranged in the toner image forming unit F3 corresponding to magenta (M). In addition, a carrier removing roller 227*a* is arranged between the photosensitive drum 221 that is arranged in the toner image forming unit F3 corresponding to magenta (M) and the photosensitive drum 231 that is arranged in the toner image forming unit F3 corresponding to cyan (C). Furthermore, a carrier removing roller 237*a* is arranged between the photosensitive drum 231 that is disposed in the toner image forming unit F3 corresponding to cyan (C) and the photosensitive drum 241 that is arranged in the toner image forming unit F3 corresponding to yellow (Y). The outer peripheral surface of each of the carrier removing rollers contacts that of the intermediate transfer drum 201.

The differences between the basic operation performed by the image forming unit G3 with this configuration and that performed by the image forming unit G1 disposed in the wet image forming device X1 in accordance with the above described first embodiment are as follows.

First, as shown in FIG. 4, the intermediate transfer drum 201 is rotationally driven in the clockwise direction (i.e., the direction of arrow P12).

In the toner image forming unit F3 corresponding to black (K) in this configuration, the photosensitive drum 211 whose outer peripheral surface contacts the intermediate transfer drum 201 rotates in the counterclockwise direction (i.e., the direction of arrow P11), and an electrostatic charging unit 212 charges the surface of the rotating photosensitive drum 211. Then, exposure and development are performed in the wet image forming device X3 as with the wet image forming device X1 in accordance with the above described first embodiment of the present invention. The first transfer bias application unit disposed in the intermediate transfer drum 201 applies a transfer bias with a polarity that is the inverse of the charging polarity of toner to the black toner image developed on the photosensitive drum 211, and the black toner image developed on the photosensitive drum 211 is formed on the outer peripheral surface of the intermediate transfer drum 201.

After the above described first transfer step, a large amount of developer, particularly carrier, will be attached to the intermediate transfer drum 201. Because of this, if additional developer is transferred in the next step while in this state, the surplus carrier will cause a problem in which "bleeding" and "dripping" are produced in the transfer image. Because of this, the following operation is performed in the carrier removing unit 217. The carrier removing roller 217*a* whose outer peripheral surface contacts that of the intermediate transfer drum 201 in synchronization with the rotation of the intermediate transfer drum 201 in the clockwise direction (i.e., the direction of arrow P12) as shown in FIG. 4 is rotated in the counterclockwise direction (i.e., the direction of arrow P14). As a result, the carrier attached to the intermediate transfer drum 201 is removed as with the wet image forming device X1 in accordance with the above described first embodiment.

In other words, the carrier removing roller 217*a* removes the carrier attached to the intermediate transfer drum 201 after the black toner image developed on the photosensitive drum 211 disposed in the toner image forming unit F3 corresponding to black (K) is transferred to the intermediate transfer drum 201, and before the magenta toner image developed on the photosensitive drum 221 disposed in the toner image forming unit F3 corresponding to magenta (M) that is located adjacent to the photosensitive drum 211 is transferred to the intermediate transfer drum 201. Because of this, it is possible to reduce the occurrence of "bleeding" and "dripping" in the toner image when the magenta toner image developed on the photosensitive drum 221 is transferred to the intermediate transfer drum 201.

Next, the intermediate transfer drum 201 rotates in the clockwise direction (i.e., the direction of arrow P12), and thus image formation with the second color, magenta (M) in this configuration, is performed. The same basic operation as that performed by the toner image forming unit F3 corresponding to black (K) is performed by the toner image forming unit F3 corresponding to magenta (M). Therefore, a description thereof will be hereinafter omitted.

Then, the carrier removing roller 227*a* removes the carrier attached to the intermediate transfer drum 201. In the same way, image formation with the third color, carrier removal, and image formation with the fourth color are performed.

After the first transfer steps of all colors are performed, the intermediate transfer drum 201 will rotates in the clockwise direction (i.e., the direction of arrow P12), and the toner image transferred on the intermediate transfer drum 201 is transferred to the recording medium 203 by the second transfer roller 202 to which the second transfer bias application unit applies a bias with a polarity that is the inverse of the charging polarity of toner. Heat is applied to the toner image transferred to the recording medium 203, and thus the toner image is fixed. As shown in FIG. 4, the recording medium 203 is transported in the direction of arrow P13.

Fourth Embodiment

A wet image forming device X4 in accordance with the fourth embodiment employs a four color tandem method in which at least an exposing unit, a photosensitive drum, and a developing unit are disposed for each of four color toners, i.e., black (K), magenta (M), cyan (C), and yellow (Y), and toner image formation of the four colors can be simultaneously performed. In addition, the wet image forming device X4 employs an intermediate transfer belt method in which the image developed on the photosensitive drum is first transferred to the intermediate transfer drum and then transferred to a sheet of recording paper and the like. In addition, the developing unit employs a two-component developing method in which development is performed with developer comprising non-magnetic toner and carrier.

First, with reference to FIG. 5, only portions of the wet image forming device X4 in accordance with the fourth embodiment of the present invention which are different from those of the wet image forming device X1 in accordance with the above described first embodiment will be hereinafter described.

When monochrome printing is performed, that is, when only a toner image forming unit F4 corresponding to black (K) is used, the wet image forming device X4 comprises separation mechanisms 361 and 371 that separate the following members from the intermediate transfer belt: a photosensitive drum corresponding to a color not used for image formation, a first transfer roller that is pressed into contact with the photosensitive drum, a carrier removing roller disposed on the downstream side in the direction of travel (i.e., the direction of arrow P) of the intermediate transfer belt from the photosensitive drum, and a support roller having the intermediate transfer belt interposed between itself and the carrier removing roller.

Figures 7A, 7B:
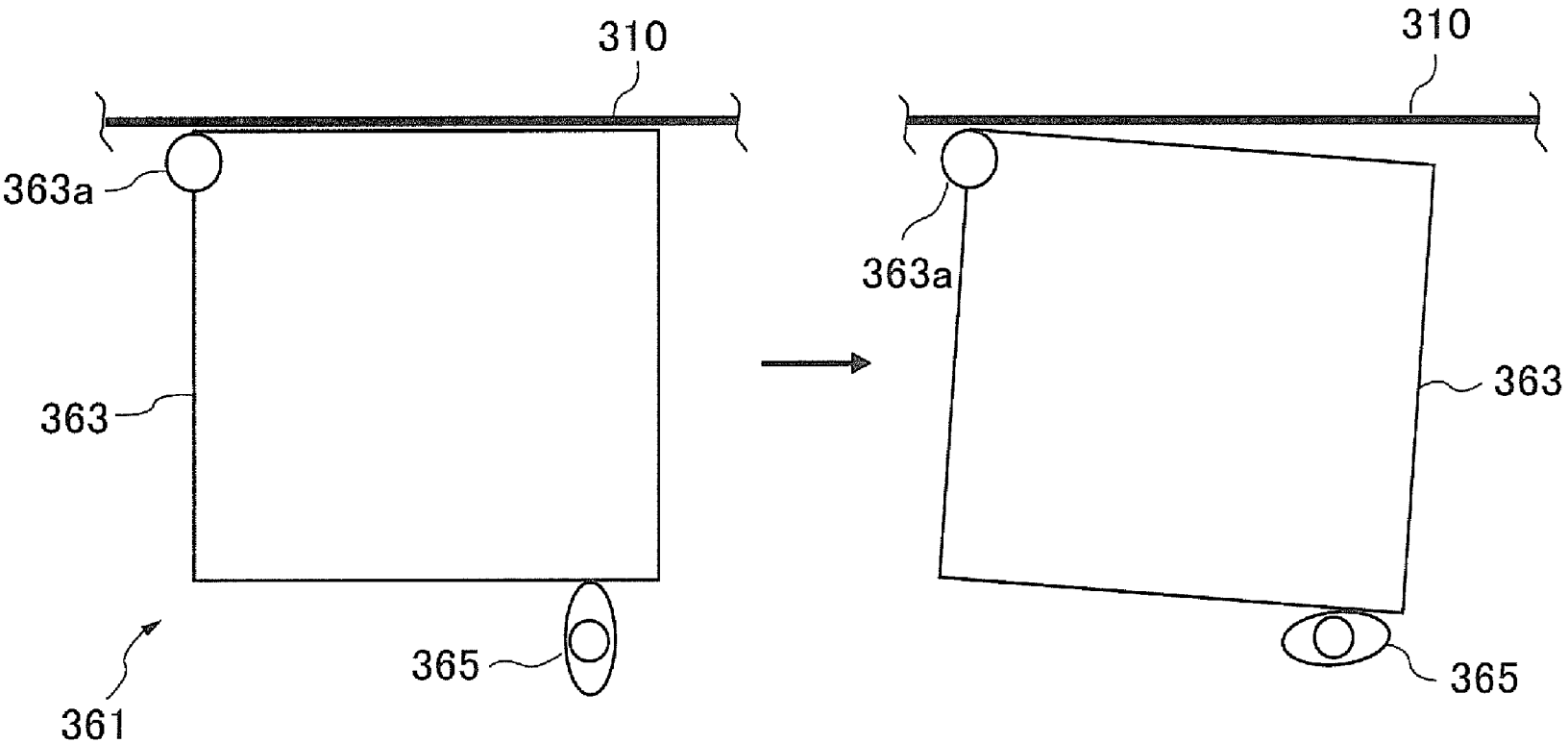
FIG. 7A shows a separation mechanism disposed below an intermediate transfer belt in accordance with the fourth embodiment of the present invention before it is operated.
FIG. 7B shows the separation mechanism after it is operated.

The separation mechanisms 361 are provided for each pair of photosensitive drum and carrier removing roller corresponding to each color, respectively. As shown in FIG. 7, each of the separation mechanisms 361 comprises a unit support member 363 that is approximately square in cross-section and to which a photosensitive drum and a carrier removing roller are respectively mounted, and a cam 365 that abuts an edge portion of the bottom surface of the unit support member 363. A rotational shaft 363*a* is disposed on an edge portion of the top surface of the unit support member 363. The unit support member 363 can rotate around the rotational shaft 363*a* functioning as a fulcrum shaft in association with rotation of the cam 365. Because of this, each pair of photosensitive drum and the carrier removing roller can be disposed in a remote position from or in a proximal position to an intermediate transfer belt 310.

Figures 8A, 8B:
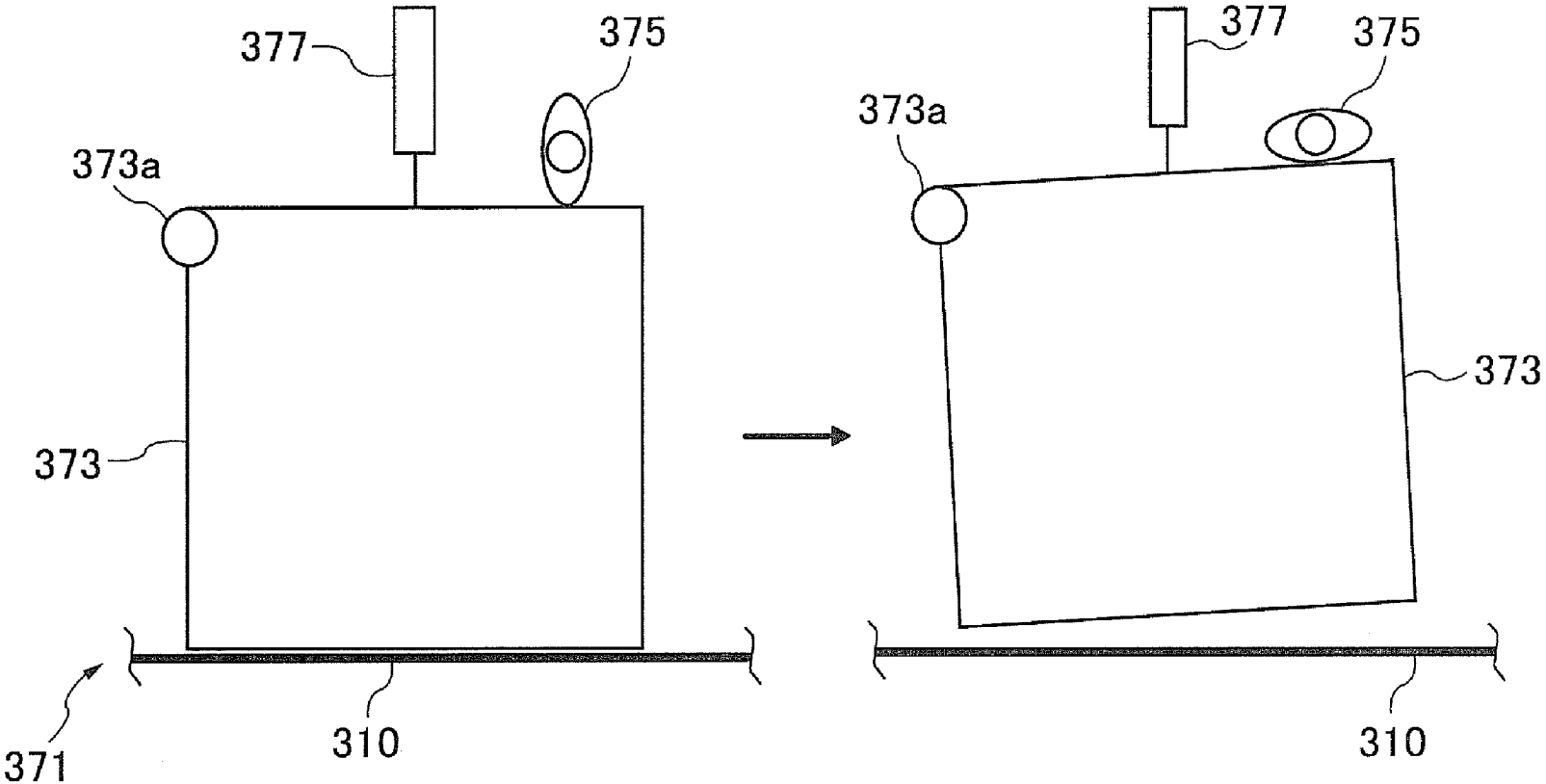
FIG. 8A shows a separation mechanism disposed above the intermediate transfer belt in accordance with the fourth embodiment of the present invention before it is operated.
FIG. 8B shows the separation mechanism after it is operated.

In addition, the separation mechanisms 371 are provided for each pair of first transfer roller and support roller corresponding to each color, respectively. As shown in FIG. 8, each of the separation mechanisms 371 comprises a unit support member 373 that is approximately square in cross-section and to which the first transfer roller and the support roller are respectively mounted, a cam 375 that abuts an edge portion of the top surface of the unit support member 373, and a spring 377 that urges the unit support member 373 upward. The spring 377 is comprised of a coil spring. A rotational shaft 373*a* is arranged on the other edge portion of the top surface of the unit support member 373. The unit support member 373 can rotate around the rotational shaft 373*a* functioning as a fulcrum shaft in association with rotation of the cam 375. Because of this, the first transfer roller and the support roller can be disposed in a remote position from or in a proximal position to the intermediate transfer belt 310.

Specifically, when monochrome printing is performed, the separation mechanism 361 moves the following members/units downward (i.e., the direction of arrow P21) as shown in FIG. 5: a photosensitive drum 321 and a carrier removing roller 327*a*, both of which are disposed in the toner image forming unit F4 corresponding to magenta (M), a photosensitive drum 331 and a carrier removing roller 337*a*, both of which are disposed in the toner image forming unit F4 corresponding to cyan (C), and a photosensitive drum 341 that is disposed in the toner image forming unit F4 corresponding to yellow (Y). Thus, these members/units are separated from the intermediate transfer belt 310. Furthermore, the separation mechanism 371 moves the following members upward (i.e., the direction of arrow P22) as shown in FIG. 5: a first transfer roller 325 and a support roller 326, both of which are disposed in the toner image forming unit F4 corresponding to magenta (M), a first transfer roller 335 and a support roller 336, both of which are disposed in the toner image forming unit F4 corresponding to cyan (C), and a first transfer roller 345 that is disposed in the toner image forming unit F4 corresponding to yellow (Y). Thus, these members are separated from the intermediate transfer belt 310. As shown in FIG. 6, the intermediate transfer belt 310 does not contact the photosensitive drum 321, the carrier removing roller 327*a*, the photosensitive drum 331, the carrier removing roller 337*a*, the photosensitive drum 341, the first transfer roller 325, the support roller 326, the first transfer roller 335, the support roller 336, and the first transfer roller 345. Because of this, excessive carrier will not be removed from the intermediate transfer belt 310 after the first transfer step. Accordingly, it is possible to reduce degradation of the image quality that is caused because the carrier is not attached at all during the second transfer step or because too little carrier is attached during the second transfer step.

After the monochrome printing is completed, the photosensitive drum, the first transfer roller, the carrier removing roller, and the support roller are returned to the original position by the separation mechanism.

Note that in the fourth embodiment, a configuration in which the separation mechanisms for separating all of the photosensitive drums corresponding to colors not used for image formation, the first transfer rollers, the carrier removing rollers, and the support rollers from the intermediate transfer belt 310 are disposed in the wet image forming device X4 is described. However, a configuration in which a one or more separation mechanisms for separating one or more of the photosensitive drums corresponding to colors not used for image formation, the first transfer rollers, the carrier removing rollers, and the support rollers from the intermediate transfer belt 310 are disposed in the wet image forming device X4 can be considered. In other words, this corresponds to a configuration in which one or more separation mechanisms for separating one or more of the image support members corresponding to colors not used for image formation, transfer rollers pressed into contact with the image support members, carrier removing members disposed on the downstream side in the direction of travel of the intermediate transfer member from the image support member, and support rollers having the intermediate transfer member interposed between themselves and the carrier removing members, from the intermediate transfer member is included.

Specifically, a configuration in which one or more separation mechanisms for separating photosensitive drums corresponding to colors not used for image formation and carrier removing rollers from an intermediate transfer belt are included can be considered. In other words, this corresponds to a configuration in which one or more separation mechanisms separate the image support members and the carrier removing members from the intermediate transfer member. Alternatively, a configuration in which the one or more separation mechanisms for separating first transfer rollers corresponding to colors not used for image formation and support rollers from the intermediate transfer belt are included can be considered. In other words, this corresponds to a configuration in which one or more separation mechanisms for separating transfer rollers and support rollers from an intermediate transfer member is included.

GENERAL INTERPRETATION OF TERMS

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applied to words having similar meanings such as the terms, "including," "having," and their derivatives. Also, the term "part," "section," "portion," "member," or "element" when used in the singular can have the dual meaning of a single part or a plurality of parts. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A wet image forming device, comprising:

a plurality of developer support members being configured to support a developer having a toner and a carrier functioning as a toner transfer agent;

a plurality of image support members, the outer peripheral surfaces being configured to contact the plurality of developer support members respectively, and to support an electrostatic latent image developed with the toner in the developer supported by the plurality of developer support members;

an intermediate transfer member, an image developed on each of the plurality of image support members being transferred to the intermediate transfer member;

a plurality of transfer rollers being pressed into contact with each of the plurality of image support members through the intermediate transfer member respectively;

one or more carrier removing members arranged between a first image support member being one of the plurality of image support members and a second image support member being located adjacent to the first image support member, and configured to remove the carrier; and a separation mechanism being configured to separate, from the intermediate transfer member, one or more of the group consisting of image support members corresponding to colors not used for image formation, the transfer rollers pressed into contact with the image support members, the one or more carrier removing members, and the support rollers having the intermediate transfer member interposed between the support rollers and the one or more carrier removing members.

2. The wet image forming device according to claim 1, further comprising a voltage application unit that applies a voltage with the same polarity as the polarity of the toner to the one or more carrier removing members.

3. The wet image forming device according to claim 1, further comprising one or more cleaning members configured to remove at least carrier attached to each of the one or more carrier removing members.

4. The wet image forming device according to claim 1, further comprising a support roller configured such that the intermediate transfer member is interposed between the support roller and the one or more carrier removing members.

5. The wet image forming device according to claim 4, wherein the wet image forming device is configured to perform monochrome image formation.

6. The wet image forming device according to claim 5, wherein the separation mechanism is configured to separate the image support members and the one or more carrier removing members from the intermediate transfer member.

7. The wet image forming device according to claim 5, wherein the separation mechanism is configured to separate the transfer rollers and the support rollers from the intermediate transfer member.

8. The wet image forming device according to claim 5, wherein the separation mechanism is configured to separate the one or more carrier removing members from the intermediate transfer member.

9. The wet image forming device according to claim 5, wherein the separation mechanism is configured to separate the image support members, the transfer rollers, the one or more carrier removing members, and the support rollers from the intermediate transfer member.

10. A wet image forming device, comprising:

a plurality of developer support members being configured to support a developer having a toner and a carrier functioning as a toner transfer agent;

a plurality of image support members, the outer peripheral surfaces being configured to contact the plurality of developer support members respectively, and to support an electrostatic latent image developed with the toner in the developer supported by the plurality of developer support members;

an intermediate transfer member, an image developed on each of the plurality of image support members being transferred to the intermediate transfer member;

a plurality of transfer rollers being pressed into contact with each of the plurality of image support members through the intermediate transfer member;

one or more carrier removing members being arranged between a first image support member that is one of the plurality of image support members and a second image support member that is located adjacent to the first image support member, and configured to remove the carrier;

a voltage application unit being configured to apply a voltage with the same polarity as the polarity of the toner to the one or more carrier removing members;

one or more cleaning member configured to at least remove carrier attached to each of the one or more carrier removing members;

a support roller being configured such that the intermediate transfer member is interposed between the support roller and the one or more carrier removing members; and a separation mechanism being configured to separate, from the intermediate transfer member, one or more of the group consisting of image support members corresponding to colors not used for image formation, the transfer rollers pressed into contact with the image support members, the one or more carrier removing members, and the support rollers having the intermediate transfer member interposed between the support rollers and the one or more carrier removing members.

11. The wet image forming device according to claim 1, the separation mechanism further includes a first unit support member that has a square cross-sectional shape, a first cam that abuts an edge portion of a bottom surface of the first unit support member, and a first rotational shaft that is disposed on an edge portion of a top surface of the first unit support member, the first unit support member rotates around the first rotational shaft where the first cam rotates.

12. The wet image forming device according to claim 11, the separation mechanism further includes a second unit support member that has a square cross-sectional shape, a second cam that abuts an edge portion of a top surface of the second unit support member, a spring that urges the second unit support member upward, and a second rotational shaft that is disposed on other edge portion of a top surface of the second unit support member, the second unit support member rotates around the second rotational shaft where the second cam rotates.

13. The wet image forming device according to claim 1, the separation mechanism further includes an unit support member that has a square cross-sectional shape, a cam that abuts an edge portion of a top surface of the unit support member, a spring that urges the unit support member upward, and a rotational shaft that is disposed on other edge portion of a top surface of the unit support member, the unit support member rotates around the rotational shaft where the cam rotates.

* * * * *